US006571428B2

(12) United States Patent
Patelli et al.

(10) Patent No.: US 6,571,428 B2
(45) Date of Patent: Jun. 3, 2003

(54) FLAT CARD WITH MULTIPLE FEED OF FIBERS IN MAT

(75) Inventors: Silvano Patelli, Palazzolo Sull'Oglio (IT); Giovanni Battista Pasini, Palazzolo Sull'Oglio (IT)

(73) Assignee: Marzoli S.p.A., Palazzolo Sull'Oglio (IT)

( * ) Notice: Subject to any disclaimer, the term of this patent is extended or adjusted under 35 U.S.C. 154(b) by 0 days.

(21) Appl. No.: 10/054,725

(22) Filed: Nov. 12, 2001

(65) Prior Publication Data

US 2002/0108214 A1 Aug. 15, 2002

(30) Foreign Application Priority Data

Nov. 17, 2000 (IT) ..... MI2000A2481

(51) Int. Cl.[7] ..... D01G 15/40
(52) U.S. Cl. ..... 19/105; 19/65 A; 19/98
(58) Field of Search ..... 19/64.5, 65 A, 19/98, 99, 100, 101, 105, 200, 201, 202, 203, 204, 205

(56) References Cited

U.S. PATENT DOCUMENTS

| | | | | |
|---|---|---|---|---|
| 4,345,356 A | * | 8/1982 | Handschuch et al. | 19/105 |
| 4,795,335 A | * | 1/1989 | Farrington et al. | 156/62.2 |
| 4,982,478 A | | 1/1991 | Stahli et al. | |
| 5,862,573 A | * | 1/1999 | Leifeld | 19/105 |
| 6,061,878 A | * | 5/2000 | Patelli et al. | 19/105 |

FOREIGN PATENT DOCUMENTS

| | | |
|---|---|---|
| DE | 0 608 686 | 8/1994 |
| EP | 0 927 799 | 7/1999 |
| EP | 0 989 213 | 3/2000 |

* cited by examiner

*Primary Examiner*—Gary L Welch
(74) *Attorney, Agent, or Firm*—Hedman & Costigan, P.C.

(57) ABSTRACT

A flat card fed with fibers by means of a plurality of feed devices comprising licker-in rollers that operate in parallel so as to feed different fibers onto different points of the main carding drum, where the feed points are set sequentially and are staggered in such a way as to constitute, on the main carding drum, a series of pre-carding areas that are specific for the fibers fed at each point and that are provided with equipment adjustable for each type of fiber that is being processed.

3 Claims, 4 Drawing Sheets

FLAT CARD WITH MULTIPLE FEED OF FIBERS IN MAT

The present application claims priority to Italian Patent Application Ser. No. MI 2000A 002481, filed Nov. 17, 2000.

SUMMARY OF THE INVENTION

The present invention relates to flat cards in which the fibre material in a thin layer is processed by a series of surfaces facing one another, in relative motion and equipped with a card clothing formed by a plurality of pins of given shapes, inclinations, and rigidities, between which the fibre material is exchanged, opened, spread, and cleaned, so eliminating the majority of the particles of residual dirt, waste and tangles or neps. In this operation, the fibres form between them a mixture or blend, and a ribbon of non-twisted fibres is formed as a web to be condensed and sent on to the subsequent processing stages.

In its broadest lines, the operation of carding of a cotton type is performed according to the diagram illustrated in FIG. 1. The raw material 1 is made up of fibre staple and is accumulated in the end part 2 of a storage bin. From the bottom of the storage bin, a system of discharging cylinders or lobed rollers 3 rotating at a controlled speed discharges, onto a chute 4, the fibres in the form of a mat 5, feeding them to the card. The latter machine is provided with a feed roller 6 which presses and controls the mat against the feed board 7 and supplies a wisp or bundle of the mat to the taker-in roller 8, which is also commonly referred to as "licker-in roller" or simply "licker-in", currently also "briseur". The said licker-in is provided with a clothing of pins and turns at a considerable speed of rotation. The fibres fed to the licker-in are roughly combed and distributed in a layer thinner than the original layer 5 arriving from the chute 4. Throughout its rotation, illustrated in FIG. 1 in the counter-clockwise direction, the layer of fibres encounters one or more opening and purification devices consisting of clothed segments and knives for removing any impurities that may be present, the said impurities then being sucked in by suction mouths and thus carried away.

Set downstream of the licker-in is the main carding drum 10. Generally speaking, the said main carding drum 10 is operated at a linear speed that is higher than the speed of the licker-in 8. The pins of the clothing of the main carding drum 10 thus remove the fibres from the licker-in in positions corresponding to the closest generatrices between the two cylinders. Located around and on the outside of the main rotating carding drum 10 and downstream of the feed system with licker-in rollers are the carding flats, which, according to the particular type of card, are of the fixed type 11, the mobile type 12, or finally the rotating type, the latter not being illustrated in the figure for reasons of simplicity. The said flats are set around the main drum for carding the fibres fed by the licker-in rollers, the said fibres, after passing over the main carding drum, being then discharged by the card downstream of the flats by discharging cylinders 13 and doffing cylinders 14.

According to the Italian patent No. 1 296 452 in the name of the same applicant, in order to obtain a better effect of cleaning and blending, the fibres fed into the card are divided between a plurality of taker-in rollers or licker-in rollers, which operate in parallel to process the fibres and then feed them to the main carding drum in different points of its circumference.

One of the advantages of the above technical solution lies in the greater effect of cleanliness and quality of the fibres coming out of the licker-in rollers due to the small thickness of the layer of fibres processed on the clothing of each licker-in. The said layer exerts, in fact, an action of retention of the particles of dirt that are found inside the layer according to the thickness of the latter: the thinner the layer, the greater the degree of cleaning.

According to an embodiment illustrated in FIG. 3 of the above-mentioned prior patent, various batches of fibres are processed, and the licker-in rollers are made to work in parallel. For this purpose, the licker-in rollers are each equipped with components and with an actuating system for operating in conditions such that they are independent of one another. Each of the licker-in rollers is driven at the desired speed and fed with bundles of fibres at the desired rate, in order to obtain the correct blending and the desired quality.

According to the type and quality of the fibres to which it is dedicated, each of the two licker-in rollers is equipped with a clothing made to measure which may be more or less aggressive, so as to obtain a higher degree of opening and cleaning of the fibres, thus limiting possible breaking of the fibres and the formation of neps. In this way, a greater efficiency and longer working life of the clothing is obtained according to the fibre on which it is designed to work.

The same arrangement is adopted for the type, number and adjustment of the components of the auxiliary elements for purifying the fibres, the equipment being basically made up of clothed segments, knives and suction mouths, again according to the type and quality of the fibres for which each of the licker-in rollers is designed. One of the consequences of the conformation of the above feed device is the delivery of the two batches of fibres at different points of the main carding drum and the stratification of the materials one on top of the other according to the reverse order of delivery onto the clothing of the main carding drum. The different position of the fibre material with respect to the asperities of the clothing gives rise to a more or less aggressive processing performed on the fibres of the two batches according to the order of their stratification.

The present invention more in particular relates to a multiple-feed card scheme with a plurality of licker-in rollers or briseur working in parallel to improve processing of the fibres fed to the card as regards their cleaning, spreading and the effect of blending of the fibres processed during carding when the batches of fibres that are fed in present substantial differences between them in their characteristics and/or behaviour.

The above-mentioned scheme is defined as a flat card in which the main card drum (10) is fed with a number of batches of fibers (A, B, . . . , H, L) by means of a plurality of feed devices ($\mathbf{2O}_A$, . . . , $\mathbf{20}_L$) comprising taker-in rollers or licker-in rollers (8A, . . . , 8L), which operate in parallel to feed, upstream of the moving flats and in different points of the main carding drum (10), the fibers which they have already roughly spread and purified in a layer that adheres to the clothing of each licker-in roller ($\mathbf{8}_A$, . . . , $\mathbf{8}_L$), characterized in that the feed points with the various licker-in rollers ($\mathbf{8}_A$, . . . , $\mathbf{8}_L$) are set in sequence and staggered according to angles ($\alpha_{AB}$, . . . , $\alpha_{HL}$) for an overall arc of circle of amplitude ($\alpha_{AB}$, . . . , $\alpha_{FL}$), in such a way as to constitute a series of pre-carding areas that are specific for each batch fed in according to the succession of batches of fibers (A, . . . , L), and in that each licker-in and each pre-carding area is provided with equipment that can be specifically regulated and adapted for each batch of fibers that is being processed.

DETAILED DESCRIPTION OF THE INVENTIONS

Figure 1:
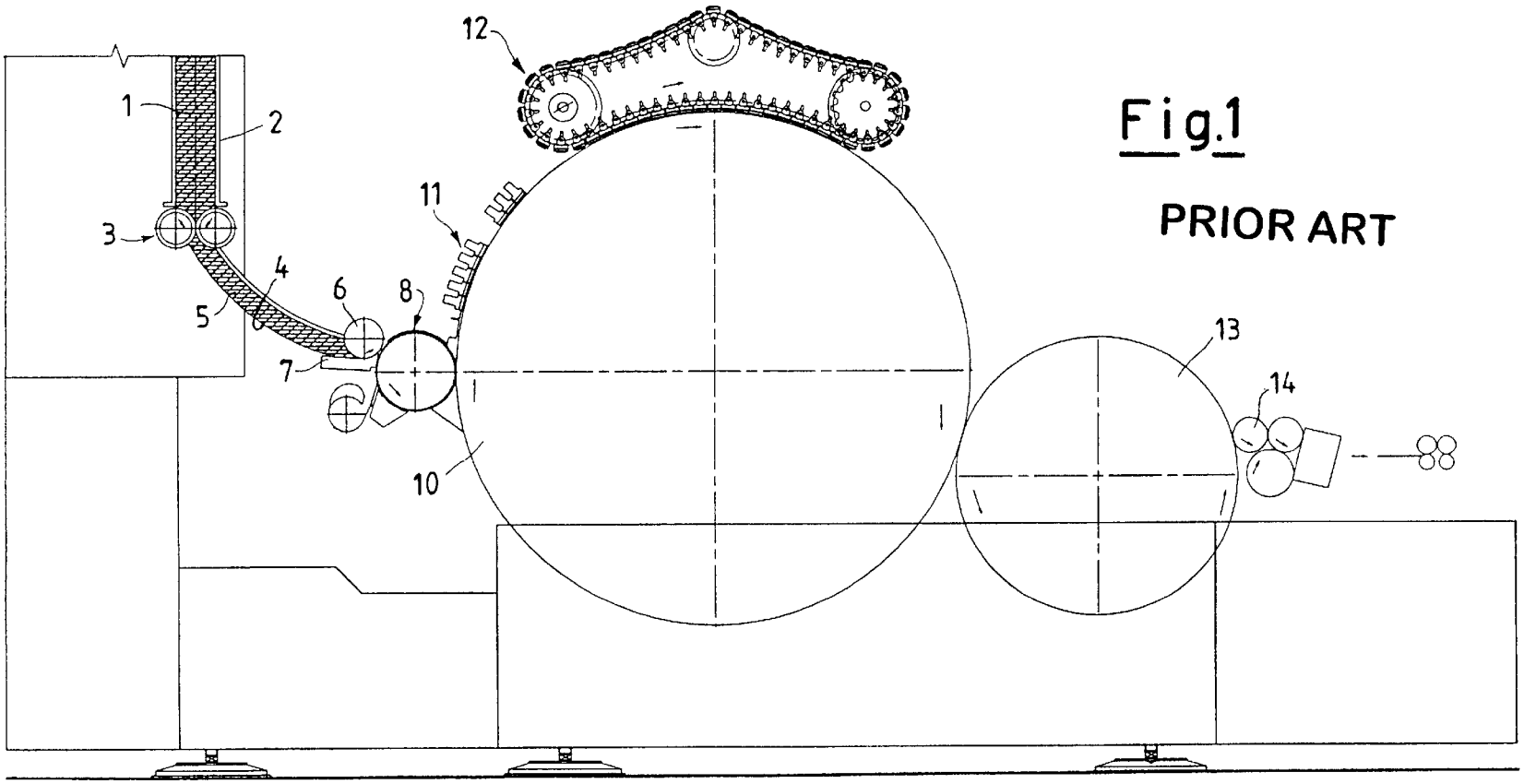
Fig.1 PRIOR ART
FIG. 1 is a description of the prior art.
Figure 3:
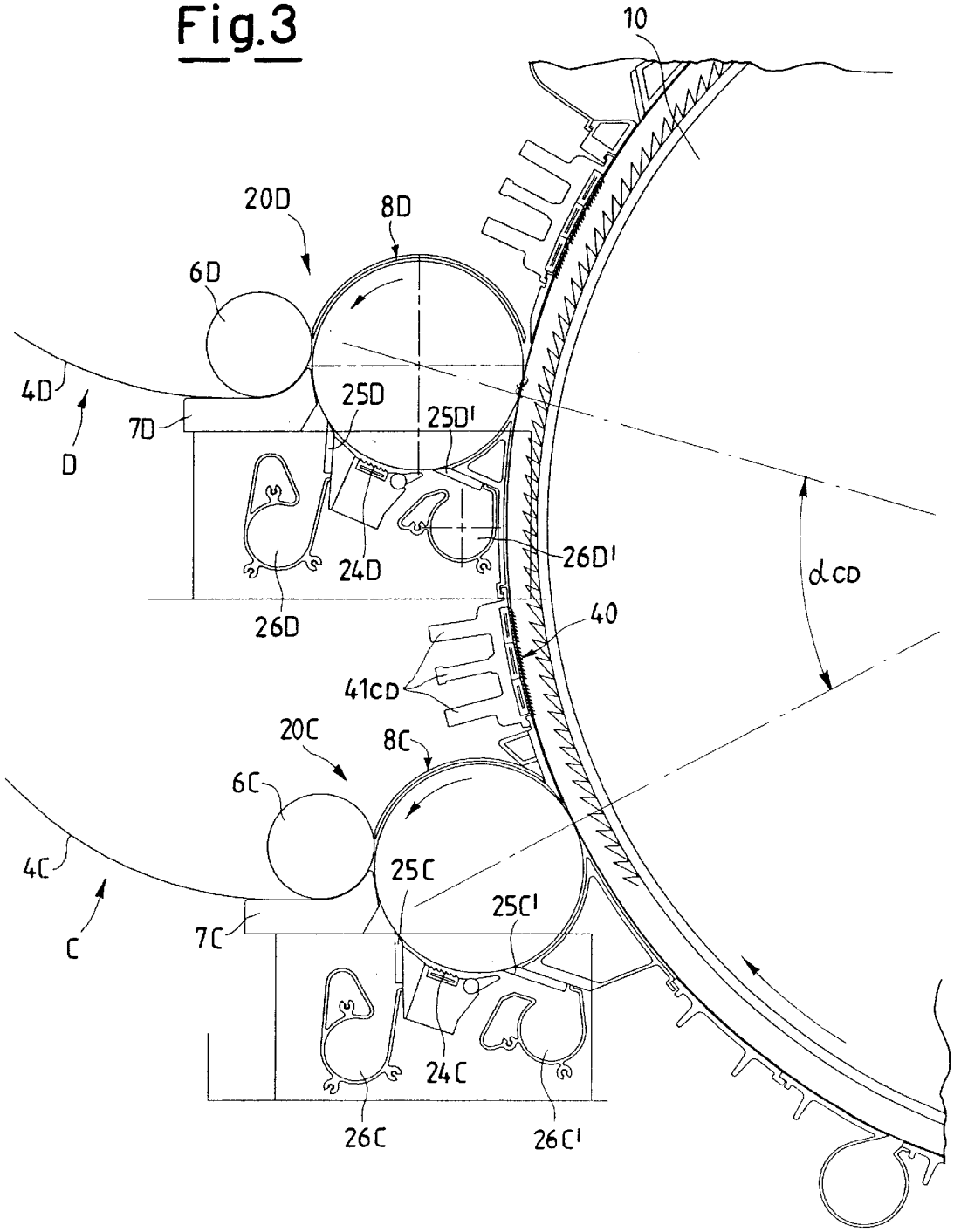
FIG. 3 is an enlarged scale of the area of feed to the main carding drum by the two licker-in rollers.
Figure 4:
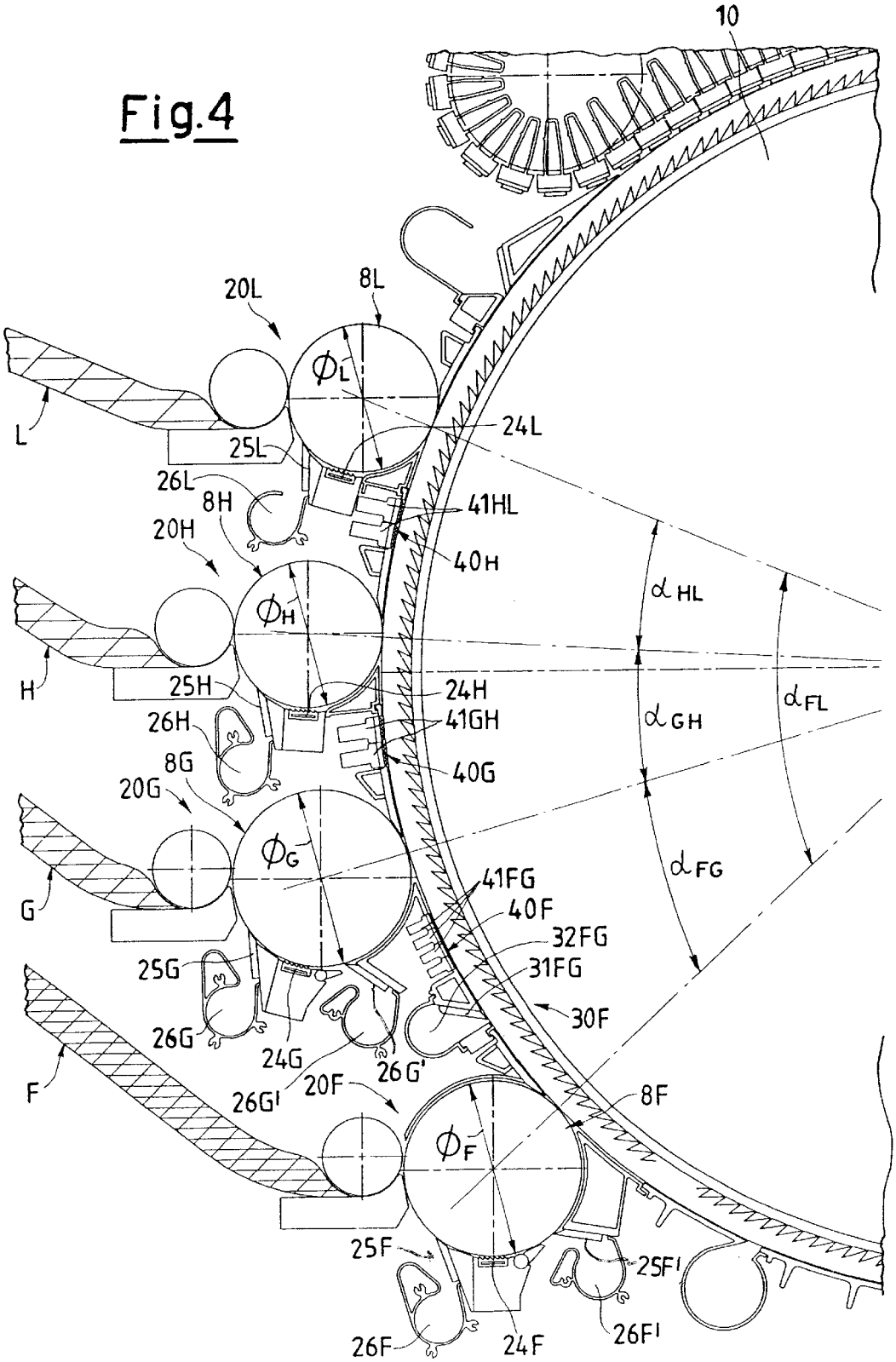
FIG. 4 is an embodiment in which four different batches of fibers are fed to the main carding drum by four feed devices.

FIG. 1 illustrates the technical problem in general terms. To illustrate the characteristics and advantages of the present invention more clearly, the invention is described with reference to some of its typical embodiments as shown in FIGS. 2, 3 and 4 purely by way of non-limiting example.

Figure 2:
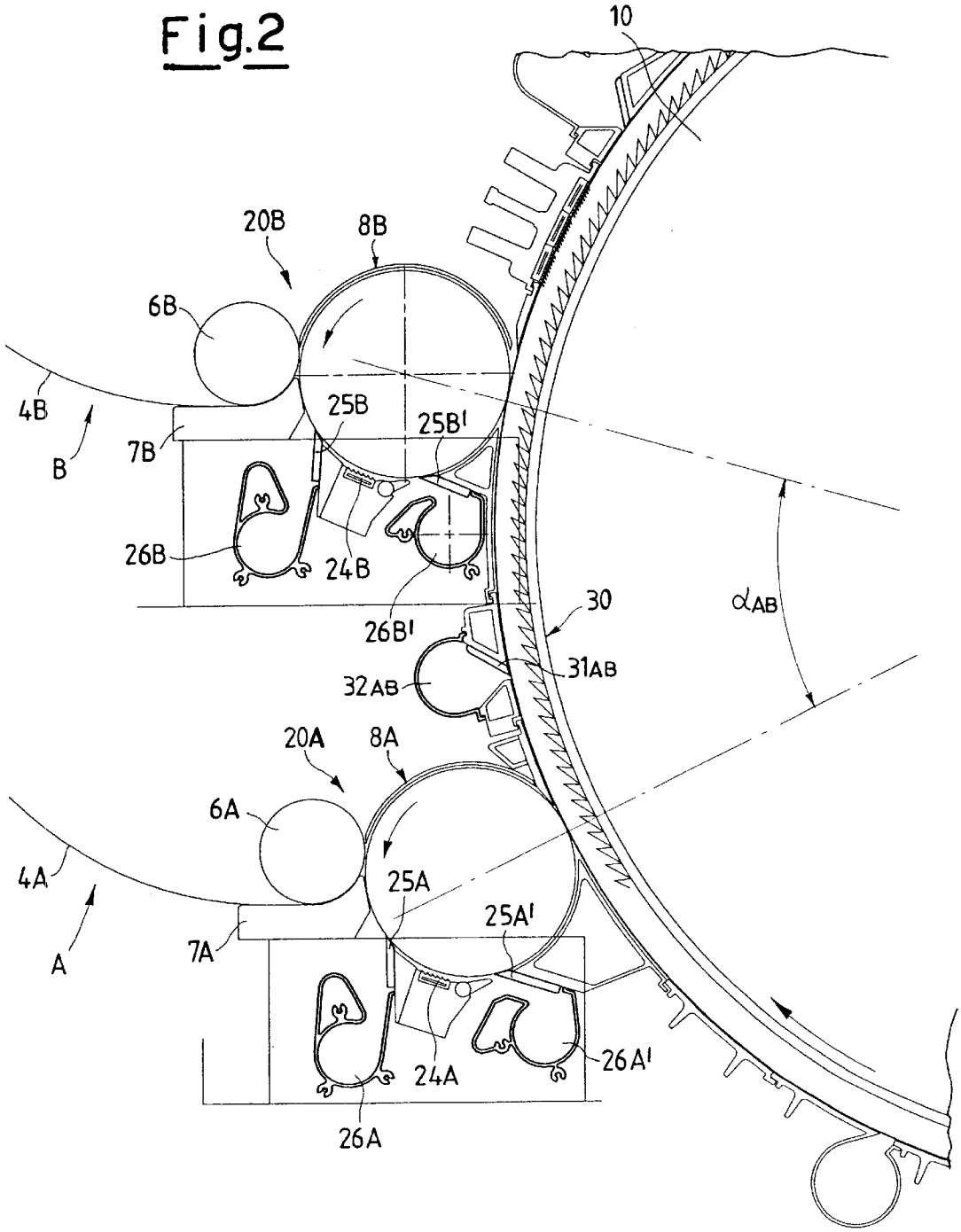
FIG. 2 is an enlargement of the feed area to the main carding drum by means of two licker-in rollers with fibers of different batches.

In the embodiment of FIG. 2, there is shown enlarged the area of feed to the main carding drum by means of two licker-in rollers with fibres of different batches. This embodiment exemplifies a case with two batches of fibres A and B, which are intended as being representative of a plurality of feeds.

The two batches are, for instance, two batches of fibres with different contents of dirt and extraneous substances and/or where the said foreign bodies are more or less difficult to remove. The fibres may be either of the same type, for instance cotton that is more or less clean belonging to two different batches, or else of different types, for example for preparing a cotton-polyester blend. The batch of fibres A, which is relatively more difficult to work, is fed by means of the feed system 20A set further upstream with reference to the clockwise direction of rotation of the main carding drum 10. The feed line, which feeds in the batch of fibres A, comes from a storage bin of its own and slides down the chute 4A until it reaches its feeder with roller 6A and board 7A, which operate to feed the licker-in 8A rotating in a counter-clockwise direction. The licker-in 8A is equipped—in a way of itself known—with a system for purifying the fibres stratified on its clothed cylindrical surface, the said system consisting of the clothed segment 24A with flow deflector, the two knives 25A and 25A', with their associated suction mouths 26A and 26A', which carry out an initial cleaning and spreading of the fibres before delivering them to the main carding drum 10. The number, shape and adjustment of said knives 25, clothed segments 24, and suction mouths 26 serving each licker-in 8 may be varied according to the degree of preliminary purification and spreading that is to be achieved for the batch of fibres envisaged for each feed device 20.

The batch of fibres B is relatively easier to work and is fed by means of the feed system 20B set further downstream with reference to the clockwise direction of rotation of the main carding drum 10.

Also the feed line of fibers B comes from a storage bin of its own and, as in the case of batch A, slides down the chute 4B until it reaches its feeder with roller 6B and board 7B, which feeds it to the licker in 8B, the latter also being equipped with a similar system 24B, 25B, 25B', 26B' for purification of the fibers stratified on its clothed surface.

The two feed systems are thus angularly staggered according to an arc of a circle of aperture $\alpha_{AB}$ which separates the two points of arrival of the batches A and B fed onto the main carding drum 10. According to a peculiar characteristic of the present invention, in the arc of circle $\alpha_{AB}$ which separates the two points of arrival of the fed batches A and B there is/are set one or more devices 30 for purification and cleaning of the fibres, the said devices consisting of knives $\mathbf{31}_{AB}$ and suction mouths $\mathbf{32}_{AB}$, which carry out a further cleaning of the batch of fibres A prior to their stratification with the fibres of batch B that are delivered to the main carding drum 10 by the feeder 20B. The effect of this is that the batch of fibres A, from which, at least to a fair extent, the impurities have been removed that can render it of poorer quality than the batch of fibres B, is blended with the batch of fibres B, and the two batches are thus processed in an effective way in the stretch in common set downstream.

Also FIG. 3, which illustrates another embodiment of the invention, shows at an enlarged scale, the area of feed to the main carding drum 10 by the two licker-in rollers 8 with fibres of different batches. This embodiment is an example of a further case with two batches of fibres C and D, which are intended as being representative of a plurality of feeds.

The two batches are, in the example illustrated in FIG. 3, two batches of fibres characterized by different degrees of tangling and/or by being more or less difficult to spread. Typically, synthetic fibres prove the ones most difficult to disentangle and spread as compared to the majority of natural fibres. The example of FIG. 3 may therefore readily be referred to the processing of a blend of natural and synthetic fibres.

The batch of fibres C is the one that is relatively more difficult to work and is fed by means of the feed system 20C set further upstream with reference to the clockwise direction of rotation of the main carding drum 10. The batch of fibres D, which is relatively easier to work, is fed by means of the feed system 20D set further downstream with reference to the clockwise direction of rotation of the main carding drum 10. The two feed systems correspond to the ones shown in the previous figure and have the same reference numbers, as well as the same arrangements and functions, but this time with the indices C and D.

Also in the case illustrated in FIG. 3 the two feed systems are angularly staggered according to an arc of a circle of aperture $\alpha_{CD}$ which separates the two points of arrival of the batches C and D fed onto the main carding drum 10. According to a further peculiar characteristic of the present invention, in the arc of circle $\alpha_{CD}$ which separates the two points of arrival of the fed batches C and D there is/are set one or more devices 40 for disentangling and spreading of the fibres, the said devices consisting, for example, of a number of clothed and fixed flats $\mathbf{41}_{CD}$ which carry out further spreading of the fibres of batch C prior to their stratification with the fibres of batch D that are delivered to the main carding drum 10 by the feeder 20D. The effect of this is that the batch of fibres C, which, at least to a fair extent, has already been spread and from which the neps that rendered it of poorer quality than the batch of fibres D have been removed, is blended with the batch of fibres D before the two batches are sent on to the carding stretch set downstream.

According to the two cases so far exemplified, the present invention envisages equipping the card with a plurality of devices 20 for preparation and feeding, these devices consisting of parallel and independent licker-in rollers 8, each of which is provided with specific equipment and adjustments for the batch of fibres for which it is designed. The said devices 20 operate in parallel and are arranged around the main carding drum 10 for feeding in different points of the said main carding drum 10 and upstream of the moving flats, the said devices 20 being angularly staggered according to angles $\alpha$ apart. In the arc of circumference of the main carding drum 10, which corresponds to each of said angular sectors of angle $\alpha$ of spacing between one feed point and the other, so spacing the subsequent feeds, specific processing devices 30, 40 are located for processing each batch of fibres, with the aim of equalizing, or at least attenuating, the differences between the characteristics of tangling (neps), dirt, and/or more or less difficult workability of the particular feed batch with respect to the batches which follow and which concur to form the overall blend of fibres on the main carding drum 10. Preferably, the batches of fibres that require more extensive preliminary processing are sent to the feed devices 20 situated further upstream so as to reserve to said batches the prevalent part of the treatments in the devices 30, 40 situated in the intermediate angular sectors a that precede the last feed, i.e., that of the fibres that are relatively easier to work.

The pre-treatment may be appropriately modulated for each batch of fibres fed to each feed device of the card according to the present invention; it is carried out according to an its improved embodiments, also with the adoption of a different diameter for each licker-in of the feed device and with actuating devices for each licker-in which enable their speed of rotation to be varied independently of that of the other licker-in rollers. This solution makes it possible to regulate, for each feed device 20A, 20B, 20C, 20D, . . . , not only the operating features and settings of the kit of knives 25, clothed segments 24 and suction mouths 26 with which each licker-in 8 is equipped, but also the length of the useful path of the fibres arranged in a layer on the clothing of the licker-in, i.e., their stay time thereon, as well as the centrifugal action exerted on them and on the foreign bodies present in them.

FIG. 4 illustrates by way of example an embodiment in which four different batches of fibres F, G, H, L are fed to the main carding drum 10 by four feed devices. The four batches are characterized by degrees of opening and dirt that are significantly different from one another. Also for the example illustrated in FIG. 4, the feed systems have the same reference numbers as those of the previous figures, as well as the same arrangements and functions, but this time have the indices F, G, H, L. The processes of pre-treatment of the batches of fibres that are relatively more difficult to work are set upstream of the ones that are easier to work.

The four batches of fibres F, G, H, L are fed by means of preparation and feed devices 20F, 20G, 20H, 20L consisting of licker-in rollers 8F, 8G, 8H, 8L, which work in parallel and independently of one another and each of which is provided with specific equipment and settings, as well as with actuating devices that are independent of those of the other licker-in rollers. By way of example, the batch F is the dirtiest and most entangled one and is set furthest upstream with reference to the clockwise direction of rotation of the main carding drum 10. The device 20F comprises a licker-in 8F having a diameter $\Phi_F$, which is larger than the diameters of the subsequent licker-in rollers, and being provided with a clothed segment 24F and, on every side, with two knives 25F and 25F' and with two suction mouths 26F and 26F' for clearing away as much as possible of the dirt already present on the licker-in 8F without at the same time causing any qualitative deterioration of the fibres, i.e., without increasing the number of breaks and/or the formation of new neps with a processing that is too aggressive. For this purpose, the greater diameter of the licker-in is useful for containing the accessories for the two cleaning stages.

In the angular sector of the arc $\alpha_{FG}$, which separates the arrival points of the feeds F and G, there is located, proceeding in the clockwise direction, first a cleaning device 30F consisting of a knife $\mathbf{31}_{FG}$ and a suction mouth $\mathbf{32}_{FG}$, and then a device 40F for spreading the fibres, the said spreading device being made up of four clothed and fixed flats $\mathbf{41}_{FG}$, which carry out cleaning and spreading of the fibres of the batch F before causing them to come into contact with the fibres of the subsequent feed of the batch of fibres G, which arrive from the corresponding licker-in. The members 30F and 40F are arranged in such a way as to bring—after the pre-treatment carried out in the arc $\alpha_{FG}$—the characteristics of the batch F to resemble as closely as possible the characteristics of the ensuing batch G. The arc $\alpha_{FG}$ is sized in such a way as to be able to contain the said members 30F and 40F.

Again by way of example, the batch G is less difficult to work than the batch F, but is dirtier and more entangled than the batches that follow. The device 20G comprises a licker-in having a diameter $\Phi_G$ which is larger than the diameters of the licker-in rollers that follow and is equipped with a clothed segment 24G and, on every side, with two knives 25G and 25G' and two suction mouths 26G and 26G' for clearing away a part of the dirt so as to bring the quality of the batch of fibres G to be similar to that of the batch fibres F which had been further pre-treated in the arc $\alpha_{FG}$.

In the angular sector of the arc $\alpha_{GH}$, which separates the arrival points of the feeds F+G and H, there is located a device 40G for spreading the fibres, the said spreading device consisting of two clothed and fixed flats $\mathbf{41}_{GH}$, which carry out a further spreading of the fibres of the batches F+G before causing them to come into contact with the subsequent feed of batch of fibres H, which also arrives from the corresponding licker-in. The member 40G is pre-arranged in such a way as to bring,—after the pre-treatment carried out in the arc $\alpha_{GH}$—the characteristics of the blend of batches F+G to resemble as closely as possible the characteristics of the ensuing batch H. Likewise, the arc $\alpha_{GH}$ is sized in such a way as to contain the member 40G.

The batch of fibres H is less difficult to work than the blend of batches F+G, but is more entangled than the batch L that follows. The device 20H comprises a licker-in having a diameter $\Phi_H$, which is smaller than the diameters of the preceding licker-in rollers, and being equipped with a clothed segment 24H, preceded by a knife 25H and a suction mouth 26H for clearing away a part of the dirt so as to bring the quality of the batch of fibres H to be similar to that of the blend of batches F+G which comes to be on the main carding drum 10 after passing through the arc $\alpha_{GH}$.

In the angular sector of the arc $\alpha_{HL}$, which separates the arrival point of the blend F+G+H from the arrival point of the last batch of fibres L—which is likely to be the one easiest to work in so far as it is the cleanest and the least entangled—there is located a device 40H for spreading the fibres, the said spreading device consisting of two clothed and fixed flats $\mathbf{41}_{HL}$, which carry out a further spreading of the fibres of the blend of batches F+G+H before causing them to come into contact with the last feed of fibres consisting of the batch of fibres L. The feeder 20L of this last batch comprises a licker-in 8L, which has a diameter $\Phi_L$ smaller than the diameters of the preceding licker-in rollers and is equipped, like the previous one, with a clothed segment 24L, a knife 25L, and a suction mouth 26L.

The overall blend of the batches F, G, H, L passes through the top arc of the main carding drum 10, where it is worked in co-operation by the clothing of the rotating main carding drum 10 and by the moving carding flats 12. After passing over the main carding drum 10, the blend of fibres is discharged by the discharging cylinder 13. The various licker-in rollers are arranged in sequence and staggered according to a plurality of angles $\alpha$, through an overall arc of circle of amplitude $\alpha_{FL}$, to constitute in this way an area of pre-carding that is specific for each batch fed in.

The overall arc of circle $\alpha_{FL}$ on which the feeders from 20F to 20L are arranged thus constitutes an area of pre-carding, or more precisely a series of areas of pre-carding, that is specific for each batch of the succession of batches of fibres fed in, and may have an amplitude of up to 120° or over, and in any case one sufficient for containing the pre-carding equipment. The choice, numbers and settings of the pre-carding pieces of equipment may be regulated and adapted each time according to the characteristics of each batch of fibres being processed, as regards the numbers, types and positions of the separator knives and associated suction mouths, as well as of the clothed carding elements both around the licker-in rollers and in the various sectors of the pre-carding arc.

According to an even more improved embodiment of the invention, the feed devices 20, together with their treating equipment on the corresponding licker-in rollers 8, are mounted on supports that can be angularly staggered with respect to the main carding drum 10 in such a way as to modify the division of the pre-carding arc between the various feeds and to make available individual amplitudes of each sector for installing the pre-treatment equipment that is best suited to each particular batch of fibres. This solution makes it possible to extend the range of the possible settings of the card and the flexibility of the card for processing blends from a number of feeds which may be very different from one another as regards the degree of dirt and entanglement of the fibres.

A further advantage of the invention lies in the fact that the card can operate effectively and produce high-quality blends even starting from materials having markedly different characteristics in terms of dirt, opening and workability. The differentiation in the sizes and speeds of the various licker-in rollers makes it possible to have, for each licker-in, a more or less extensive working surface at the disposal the processing members and a centrifugal action that is specific for each batch of fibres that is fed in.

The invention moreover makes it possible to widen the range of cotton-cut raw materials that can be processed in a carding machine to form blends of fibres that are homogeneous in terms of cleaning and opening, both owing to an appropriate conformation and regulation of the feed and pre-carding equipment, and thanks to the adoption of the sequence of feeds according to a decreasing order of processing difficulty. The processing-battery line from the raw fibre to the web of purified and parallelized fibres is rendered both more adaptable to the available batches of fibres and more flexible as regards the requirements of the units of the plant that are set downstream, as well as more in line with the demands of the market.

The availability of a multiplicity of feeds in the card according to the invention makes it possible to regulate, by distributing it over a number of feeds, the incoming flow of batches of fibres that are most difficult to work. For example, on the card with four feed devices of the example illustrated in FIG. 4, it is possible to process and produce a blend with three batches of fibres, reserving the first two feed stations to the first of the three batches, i.e., the one that is most difficult to work. In this way, each of the two initial licker-in rollers works on a thinner layer of fibres, thus obtaining a higher degree of cleaning and spreading of the said fibres that are more difficult to work. The same higher degree of efficiency is achieved in the two pre-carding areas that follow the two initial feed stations.

What is claimed is:

1. A flat card in which the main card drum (10) is fed with a number of batches of fibers (A, B, . . . , H, L) by means of a plurality of feed devices ($\mathbf{20}_A$, . . . , $\mathbf{20}_L$) comprising taker-in rollers or licker-in rollers (8A, . . . , 8L), which operate in parallel to feed, upstream of moving flats and in different points of the main carding drum (10), the fibers which they have already roughly spread and purified in a layer that adheres to clothing of each licker-in roller ($\mathbf{8}_A$, . . . , $\mathbf{8}_L$), characterized in that the feed points with the various licker-in rollers ($\mathbf{8}_A$, . . . , $\mathbf{8}_L$) are set in sequence and staggered according to angles ($\alpha_{AB}$, . . . , $\alpha_{HL}$) for an overall arc of circle of amplitude ($\alpha_{AB}$, . . . ,$\alpha_{HL}$), in such a way as to constitute a series of pre-carding areas that are specific for each batch fed in according to the succession of batches of fibers (A, . . . , L), and in that each licker-in and each pre-carding area is provided with equipment that can be specifically regulated and adapted for each batch of fibers that is being processed.

2. The flat card according to claim 1, characterized in that the various licker-in rollers (8) are set in sequence and staggered according to angles ($\alpha_{AB}$, . . . ,$\alpha_{HL}$) for an overall arc of circle of amplitude ($\alpha_{AB}$, . . . ,$\alpha_{FL}$), in such a way that each licker-in roller constitutes a pre-carding area that is specific for each batch fed in.

3. The flat card according to claim 2, characterized in that each of the angular sectors of angle $\alpha$ of staggering between one feed ($\mathbf{20}_A$, . . . , $\mathbf{20}_L$) and another, preceding the subsequent feeds, there are located processing devices (30, 40) which are specific for each batch of fibres and have the function respectively of purifying by means of knives (31) and suction mouths (32) and of spreading by means of fixed flats (41), and which are designed for the specific processing, which may be more or less difficult, of a particular batch.

* * * * *